United States Patent [19]

Lonardi

[11] Patent Number: 4,812,092

[45] Date of Patent: Mar. 14, 1989

[54] FEED HOPPER FOR A LOADING INSTALLATION OF A SHAFT FURNACE

[75] Inventor: Emile Lonardi, L-Bascharage, Luxembourg

[73] Assignee: Paul Wurth S.A., Luxembourg

[21] Appl. No.: 168,900

[22] Filed: Mar. 16, 1988

[30] Foreign Application Priority Data

Mar. 24, 1987 [LU] Luxembourg ..... 86819

[51] Int. Cl.[4] ..... F23K 3/06

[52] U.S. Cl. ..... 414/199; 110/108; 110/293; 432/76; 222/502; 222/505; 222/168; 209/910

[58] Field of Search ..... 414/155, 160, 163–164, 414/168, 178, 180, 199, 209, 411, 412, 586–588; 110/108, 116, 118, 267, 293, 327; 432/3, 76, 97; 222/502–505, 556, 558, 560, 168; 220/8, 66, 85 SP; 209/244, 910, 919

[56] References Cited

U.S. PATENT DOCUMENTS

| | | | |
|---|---|---|---|
| 3,633,897 | 1/1972 | Vogel | 414/167 X |
| 3,709,387 | 1/1973 | Kinzler et al. | 414/164 |
| 4,273,492 | 6/1981 | Legille et al. | 414/160 |
| 4,306,827 | 12/1981 | Tsutsumi et al. | 414/160 |

*Primary Examiner*—Robert J. Spar
*Assistant Examiner*—William M. Hienz
*Attorney, Agent, or Firm*—Fishman, Dionne & Cantor

[57] ABSTRACT

The hopper comprises a cylindrical side wall supported by an annular rolling ring so as to be rotatable about its vertical axis, and a funnel shaped bottom with a central outflow orifice controlled by a valve. To allow rapid removal of the rolling ring, the bottom is separated from the side wall and rests freely on an inner edge of the latter. An apparatus is provided for raising the bottom within the wall and for lifting the side wall slightly from the rolling ring.

4 Claims, 1 Drawing Sheet

FEED HOPPER FOR A LOADING INSTALLATION OF A SHAFT FURNACE

BACKGROUND OF THE INVENTION

This invention relates to a feed hopper for a loading installation of a shaft furnace. More particularly, this invention relates to a feed hopper for a loading installation of a shaft furnace of the type comprising a side wall supported by an annular rolling ring such that the side-wall is rotatable about its vertical axis; and a funnel shaped bottom with a central outflow orifice controlled by a shut-off and non-return and/or proportioning valve.

Although not being limited thereto in its utility, the present invention is particularly well suited for use as a stand-by hopper for a central loading installation of the type described in document EP-B1 No. 62,770, corresponding to U.S. Pat. No. 4,514,129, assigned to the assignee hereof. This prior installation has a central large volume feed lock chamber surmounted by a stand-by hopper for filling the lock chamber located thereunder when the latter is disconnected from the furnace.

To mitigate the problem of segregation occurring in the stand-by hopper during the filling and emptying of the hopper, it has been proposed to make the hopper rotate about its vertical axis and, for this purpose, to mount it, for example, on an annular rolling ring. However, such a mounting of the hopper causes a serious problem with respect to the removal and replacement of the rolling ring. In fact, because the rolling ring is in one piece and extends around the bottom of the hopper, the hopper has to be dismantled before the rolling ring can be laterally detached.

SUMMARY OF THE INVENTION

The above discussed and other problems and deficiencies of the prior art are overcome or alleviated by the feed hopper for a loading installation of a shaft furnace of the present invention which allows rapid removal of the rolling ring without the need to initially detach the hopper itself.

The present invention comprises a feed hopper of the type having a side wall supported by an annular rolling ring and a funnel shaped bottom with a central outflow orifice controlled by a shut-off and non-return and/or proportioning valve. In a preferred embodiment of the present invention, the hopper is separated from the side wall and rests freely on an inner edge of the side wall. In addition, means are provided for raising the bottom within the side wall; and means are provided for lifting the side wall slightly from the rolling ring.

In accordance with the present invention, the hopper is equipped with at least three lugs which can be attached to the lower ends of cables, the opposite ends of which are attached by means of winches to a tie bar having at least three branches and being carried by the upper edge of the side wall. If there are no branches, the cone or funnel shaped hopper bottom can be suspended on lugs fastened to the end of the cylinder of the hopper. These lugs permit the hopper bottom to be raised into the hopper.

Similarily, in order that the side wall can be raised, the side wall can be equipped, from the outside, with at least three lugs which can be attached to the lower ends of cables, the upper ends of which are attached to a fixed supporting framework by means of winches.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several Figures.

DESCRIPTION OF THE PREFERRED EMBODIMENT

Figure 1:
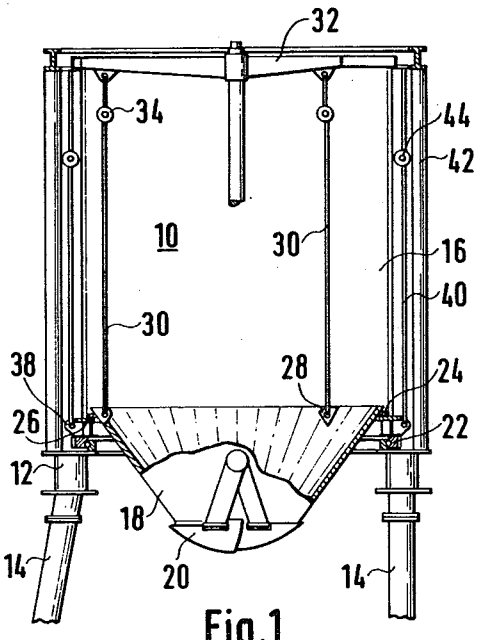
FIG. 1 is a diagrammatic view, partially in vertical cross section, of a feed hopper in the operating position in accordance with the present invention.

Referring first to FIG. 1, a feed hopper identified at 10 is carried by a circular or square beam 12 resting on several pillars 14. In turn, pillars 14 are supported by a fixed framework around the furnace or directly by the head of the furnace. In the illustrated example, hopper 10 comprises a cylindrical side wall 16 and a funnel shaped bottom 18, the outflow orifice of which is adjusted by means of a shut-off valve 20.

Hopper 10 rests with its side wall 16 on beam 12 by means of a rolling ring 22, thus allowing hopper 10 to be rotated about its vertical axis by known means (not shown) to avoid the problems of segregation of particles of differing granulometry during the filling of the hopper.

As shown in FIG. 1, it is not possible to laterally detach rolling ring 22 even if it is freed by slightly raising hopper 10, because bottom 18 prevents rolling ring 22 from being detached in this way. Therefore, it is necessary to initially remove the hopper or sufficiently lift it to ensure that bottom 18 and valve 20 allow rolling ring 22 to be laterally detached.

Figure 2:
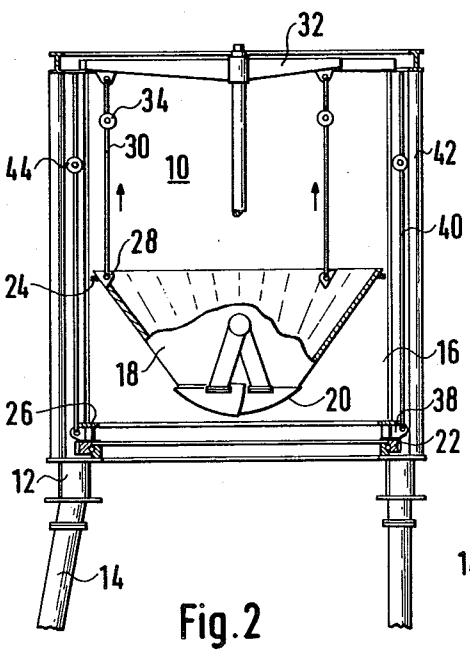
FIG. 2 is a diagrammatic view of the feed hopper of FIG. 1, with the bottom of the hopper being retracted within the side wall.

In accordance with the present invention, hopper 10 is made in two parts as a result of the separation of side wall 16 from bottom 18. In the illustrated example, bottom 18 has a peripheral upper edge 24, by means of which it rests freely on an inner peripheral edge 26 at the bottom of side wall 16. This makes it possible to raise bottom 18 within side wall 16, as shown in FIG. 2. This raising can be carried out, for example by means of cables 30 which are attached to several (for example three) lugs 28 provided in the upper part of bottom 18. Cables 30 can be attached to a tie bar 32 with three branches. Tie bar 32 rests on the upper edge of side wall 16 and is usually continuously present to ensure the distribution of the hydraulic and/or electrical circuits for actuating valve 20 and/or to provide a distribution bearing inside hopper 10. The winding of cables 30, that is, the raising of bottom 18, can be carried out by means of winches indicated diagrammatically at 34. For safety reasons, cables 30 can be backed up by three bars of fixed length.

Figure 3:
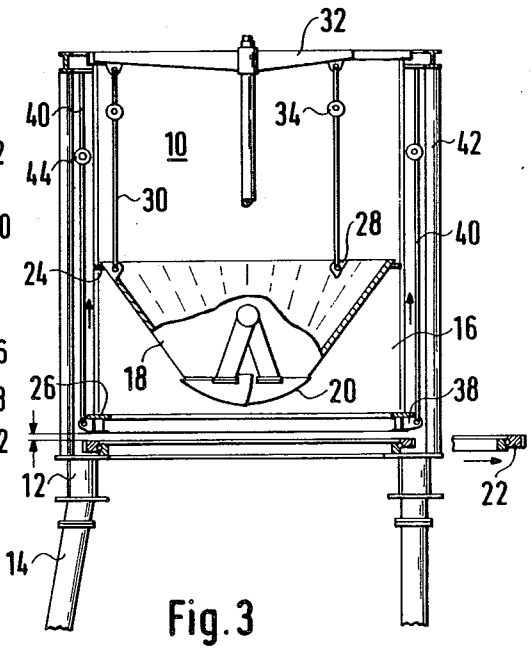
FIG. 3 is a diagrammatic view of the feed hopper of FIG. 1, with the side wall being lifted slightly from its seat.

As shown in FIG. 3, to enable rolling ring 22 to be laterally detached, side wall 10 is lifted slightly to a sufficient height to free rolling ring 22 from the pressure exerted by the weight of hopper 10. It is then sufficient to unbolt rolling ring 22 and detach it, without it being impeded by bottom 18 of hopper 10.

To lift side wall 16, it is possible (for example as shown in the Figures), to provide lugs 38 on the outer surface of wall 16, to which are attached cables 40 carried by fixed pillars 42 forming part of the fixed structure supporting hopper 10. The pull exerted by the cables can be ensured, for example, by means of winches shown diagrammatically at 44.

It will be appreciated that suitable means other than cables and winches may be provided for raising bottom 1 and wall 16. For example, the latter can be lifted by means of a rack system.

In addition, it will be appreciated that side wall 16 and bottom 18 may be raised by means of the same cables and the same winches. For this purpose, instead of attaching cables 40 to pillars 42, it is sufficient to provide return pulleys at the top thereof; and to guide cables 40 around these pulleys towards the inside of hopper 10 in order to attach them to lugs 28 at bottom 18. There would also have to be on the inner face of wall 16, level with the point where bottom 18 is to be stopped, at least three limit stops for stopping the raising of bottom 18. Starting from the position shown in FIG. 1, the actuation of winches 44 would consequently cause bottom 18 to be raised until they stop up against the stops (not shown), after which wall 16 would be raised under the double effect of the pull exerted by bottom 18 on wall 16 by means of the stops and the pull of the other end of the cable on lugs 38. The same effect could be obtained by attaching cables 40 directly to pillars 42 in order to lift side wall 16 simply as a result of the effect of the pull exerted by bottom 18 on the limit stops.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Feed hopper for the loading installation of a shaft furnace comprising:

a cylindrical side wall having a vertical axis and being supported by an annular rolling ring wherein said side wall is rotatable about said vertical axis, said side wall having a lower inner edge;

a funnel shaped bottom having a central outflow orifice controlled by a valve;

said bottom being separated from said side wall and resting freely on said inner edge of said side wall;

raising means for raising said bottom within said side wall; and lifting means for lifting said side wall slightly from said rolling ring.

2. Hopper according to claim 1 wherein said side wall has an upper edge and wherein said bottom of said hopper includes:

at least three lugs attachable to first ends of cables, the opposite second ends of said cables being attached by winch means to tie bar means having at least three branches and being carried by said upper edge of said side wall.

3. Hopper according to claim 1 wherein said side includes:

at least three lugs attachable to first ends of cables, the opposite second ends of said cables being attached by winch means to a fixed supporting framework.

4. Hopper according to claim 1 wherein:

said bottom includes an upper outer edge which rests on said lower inner edge of said side wall.

* * * * *